United States Patent [19]

Renner

[11] Patent Number: 4,930,549

[45] Date of Patent: Jun. 5, 1990

[54] WASHING MACHINE HOSE PROTECTOR

[76] Inventor: Brian K. Renner, Rte. 1, Cleveland, Mo. 64734

[21] Appl. No.: 322,180

[22] Filed: Mar. 10, 1989

[51] Int. Cl.[5] ..... F16L 55/16

[52] U.S. Cl. ..... 137/312; 68/207; 138/104; 138/113; 222/108; 285/13; 285/188

[58] Field of Search ..... 68/12 R, 207; 134/57 D, 134/58 D; 138/104, 113; 137/312, 594, 599.1; 222/108; 285/13, 14, 45, 133.1, 188

[56] References Cited

U.S. PATENT DOCUMENTS

| | | | |
|---|---|---|---|
| 1,298,258 | 3/1919 | Richards | 285/13 |
| 3,830,290 | 8/1974 | Thamasett et al. | 138/104 |
| 3,850,199 | 11/1974 | Stone et al. | 68/207 |
| 3,860,269 | 1/1975 | Horton et al. | 285/133.1 |
| 3,930,516 | 1/1976 | Flinner et al. | 137/312 |
| 4,249,568 | 2/1981 | Duggan | 137/312 |
| 4,380,243 | 4/1983 | Braley | 134/57 D |
| 4,445,332 | 5/1984 | Thies et al. | 285/13 |
| 4,644,780 | 2/1987 | Jeter | 138/104 |
| 4,786,088 | 11/1988 | Ziu | 138/113 |

FOREIGN PATENT DOCUMENTS

| | | | |
|---|---|---|---|
| 2823262 | 12/1979 | Fed. Rep. of Germany | 137/312 |
| 1198020 | 12/1959 | France | 68/207 |

*Primary Examiner*—George L. Walton

[57] ABSTRACT

An attachment for an appliance such as a washing machine that is connected to a water or other fluid inlet source that surrounds the hose connections from the fluid source to the appliance in a manner that prevents any leakage from the connector hoses from escaping into the vicinity around the appliance and flooding that area. Any excess fluid is instead directed via a drainage hose into an appropriate drainage site. The hose protector device has sleeves that cover and surround each individual hose connected to the appliance. The sleeves are interconnected to each other by a bridging conduit positioned between the sleeves. A drainage hose is attached to one of the interconnecting means and the sleeves so that any fluid accumulating in the sleeves is transported out of the sleeves through the drainage hose and into the appropriate drainage site, such as a floor drain or standpipe. A backflow prevention valve may be attached to the drainage hose to prevent any fluid from a backed up sewer to enter into the hose protector device. The hose protector device sleeves are attached to the fluid inlet source and the appliance in a manner to obtain a leakproof connection.

12 Claims, 2 Drawing Sheets

WASHING MACHINE HOSE PROTECTOR

BACKGROUND OF THE INVENTION

This invention relates in general to an attachment for an appliance that is connected to a fluid source and more particularly to such a device that surrounds the hoses that carry the fluid into the appliance in a manner such that it is capable of directing any fluid escaping from the hoses to an appropriate drainage site.

A number of appliances that are used routinely in homes and businesses are necessarily connected to a fluid source, typically a water source. Among these appliances are washing machines, dishwashers and water heaters. The appliance is generally attached to the water source by a rubber or plastic hose that transports the water or other fluid into the appliance. A separate fluid outlet hose is normally connected to the appliance for directing the used water to an appropriate drainage site such as a floor drain or a standpipe.

These appliances are often subject to repeated use by the user. The repeated influx of water into the hose at high pressure tends to break down the strength of the hose over time. As a result of such constant use, the hoses may begin to leak and may eventually rupture causing substantial flooding to the area surrounding the appliance. Additionally, the hoses are usually connected to both the water source and the appliance by metal or plastic threaded nozzle fittings. These fittings can also become worn or rusted over time and likewise become susceptible to leakage or complete failure.

When one of the hoses or fittings on such appliance ruptures or begins to leak there is rarely any advance notice to the owner. These hoses and connections are usually positioned behind the appliance and are thereby obstructed from normal view during use. Thus, any wear on the hoses or fittings often goes unnoticed until it is too late.

When a hose or nozzle fitting breaks, the damage is considerable. The water escaping from a ruptured line or fitting will flood the area surrounding the appliance with water. This problem is most often accompanied with washing machines. As most homeowners are aware, water damage is very serious and costly to repair. The accumulation of water following a hose or fitting rupture will destroy or seriously damage the floor and any floor covering in the vicinity of the appliance. Additional damage can be done to other items that are on the floor or in the path of the flooding waters. The damage is especially significant when the floor covering is carpet or wood, but concrete floors or linoleum floor coverings are not spared. The water may seep into small cracks in the concrete and lead to considerable structural damage over time. For linoleum or tiled floors, the flooding waters may seep under tiles and cause them to become dislodged by eroding the underlying glue.

While serious damage can occur very rapidly when a hose line ruptures, extensive damage is also occasioned by a continuous leak from one of the hoses or fittings. A small or moderate leak may go unnoticed by the user for long periods of time and may cause serious water damage to the surrounding areas.

Even though this is such a common and damaging occurrence, there is no known product that adequately solves the problem. It is thus evident that a need exists for a device that protects the user of appliances that are connected to water or fluid sources from sudden and unexpected flooding of the area surrounding the appliance due to the rupture or leakage of a hose carrying a fluid into the appliance.

It is therefore a primary object of the present invention to provide a device that protects appliance fluid inlet hoses and attached nozzle fittings in the event of a leak or rupture of the hose or nozzle fitting and that prevents flooding and damage to the surrounding area.

It is another object of the present invention to provide a device that surrounds the fluid inlet hoses of an appliance in a manner to capture fluid escaping from a faulty hose or nozzle fitting and directs the escaping fluid to an appropriate drainage site.

It is a further object of the present invention to provide a device that prevents ruptured or leaking washing machine water inlet hoses from causing any serious water damage to the area around the washing machine by providing two flexible, interconnected sleeves that cover the hot and cold water inlet hoses connected to the washing machine and that can direct escaping water to a floor drain or standpipe.

It is a still further object of the present invention to provide an inexpensive and effective means for protecting appliance water inlet hoses from creating water damage to the area surrounding the appliance in the event of a rupture or leak in the inlet hoses.

It is still another object of the present invention to provide such a device that can be adapted to various sizes of water inlet hoses and lengths of inlet hoses that may be presented by washing machines or other appliances having water inlet hoses.

It is yet another object of the present invention to provide such a device that can easily be installed by the owner of the appliance.

SUMMARY OF THE INVENTION

This invention is directed to a device that slides over and surrounds fluid inlet hoses that are connected to an appliance at one end and to a fluid source at its other end for delivering a fluid such as water to the appliance. The device protects the owner of the appliance from damage caused by flooding of the surrounding area in the event of a hose rupture or leak. The hose protector comprises a pair of oversized, flexible sleeves that slidably fit over the fluid inlet hoses and that are securely attached to the ends of the fluid inlet hoses so as to prevent any leakage from the sleeves. This is accomplished through the use of appropriately sized washers fitted between the sleeves and the ends of the inlet hoses such that the sleeves are opened to their fullest diameter. Adjustable hose clamps positioned on the outside of the sleeves in relationship with the washers allow the sleeves to be tightened about the washers and inlet hose ends. The sleeves are interconnected by a bridging conduit placed between the sleeves that also has a drainage hose coupled thereto. The drainage hose is preferably flexible and can be placed into an appropriate drain. The drainage hose may also be adapted for particular types and sizes of drain pipes or sewer connections. A backflow prevention valve may also be positioned between the bridging conduit and the drainage hose.

This device has particular utility for washing machines and the hot and cold water inlet hoses connected to a washing machine.

BRIEF DESCRIPTION OF THE DRAWINGS

In the accompanying drawings in which like reference numerals are used to indicate like parts in the various views.

DESCRIPTION OF THE PREFERRED EMBODIMENT

Figure 1:
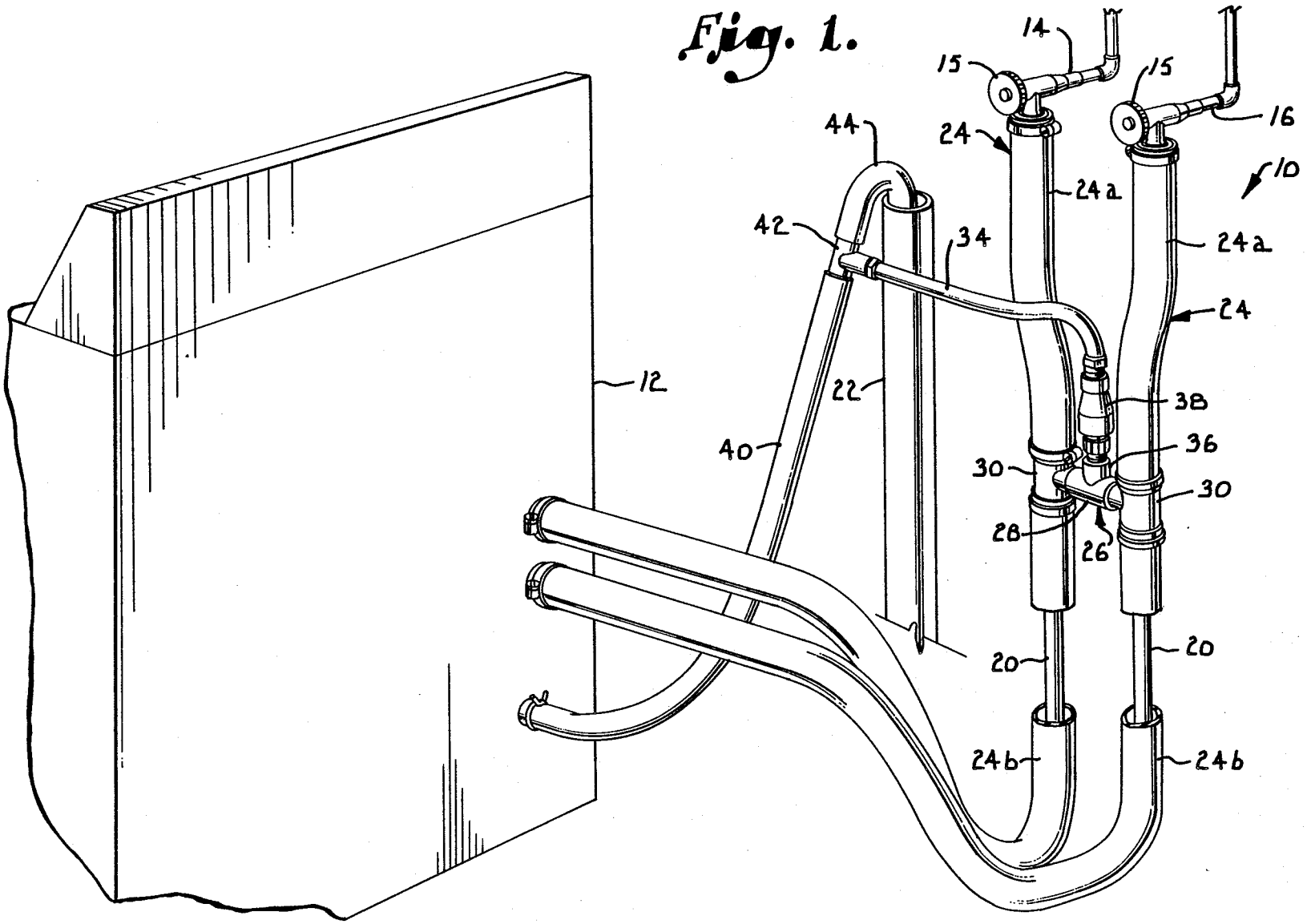
FIG. 1 is a perspective view of the device of the present invention installed on a washing machine.

The device of the present invention is depicted generally in FIG. 1 and given the numeral 10. As shown in FIG. 1, the device 10 is an attachment for use with an appliance such as a washing machine 12. While the preferred use of the present invention is in conjunction with a washing machine, any other appliance having fluid inlet hoses or lines could also use the teachings of this invention beneficially.

By necessity, a clothes washing machine is normally located near a fluid inlet source. A washing machine 12 needs access to both hot and cold water and most homes, apartments and some businesses are equipped with the pipes and necessary fittings for attachment of a washing machine. As shown in FIG. 1, a hot water line 14 and a cold water line 16 are shown in a typical manner suitable for the purpose of attachment to washing machine 12. Each water line 14 and 16 will typically present a threaded spout !not shown) through which the water can flow and onto which a hose 20 having a threaded nozzle fitting 18 on its ends (FIG. 2) can be attached. A threaded coupler or inlet port (not shown) is also standard equipment on the back side of washing machine 12 for the purpose of connecting the other end of hose 20 to the machine. In normal use, a properly sized length of hose 20 having a threaded nozzle fitting 18 at each end is connected to the hot water line 14 at one end and to the hot water inlet port on the washing machine 12. A similar hose 20 is fitted to the cold water line 16 and the proper cold water inlet port on washing machine 12. When hot and cold water lines 14 and 16 are turned on through use of handles 15, water flows through hoses 20 and into the washing machine 12 at the appropriate time as determined by the mechanics of washing machine 12.

It is also necessary for the water used by washing machine 12 to be removed therefrom and properly disposed of after processed by washing machine 12. For this purpose, standard equipment on a washing machine is an outlet hose 40 to carry used water from washing machine 12. Again, most homes, apartments or businesses are equipped with a floor drain or standpipe in the vicinity of the hot and cold water lines 14 and 16 where an appliance such as a washing machine is suggested to be attached. In FIG. 1, a standpipe 22 is shown, but it is to be understood that any appropriate drainage site such as a floor drain would be equally applicable and prevalent among homes and businesses.

Figures 2, 3, 4:
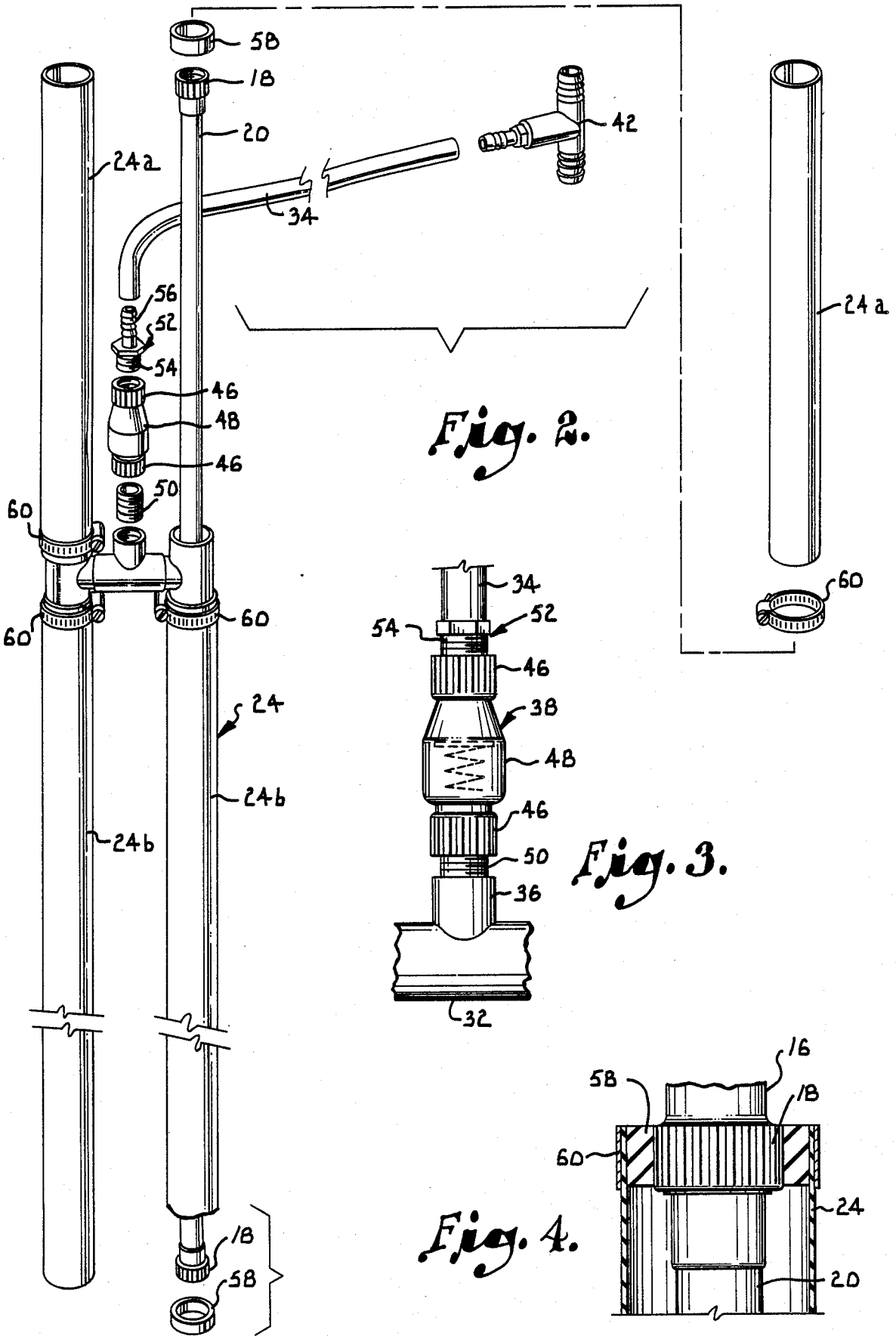
FIG. 2 is a fragmentary front elevational view of the hose protector of the present invention.
FIG. 3 is a front elevational view of the backflow prevention valve that is a part of the present invention.
FIG. 4 is a cross-sectional view of the means for coupling the sleeves of the device to the fluid inlet hoses.

Turning now to the hose protector device of the present invention, and FIG. 2 in particular, device 10 comprises a pair of sleeves 24 that cover and surround hoses 20 by slidably fitting thereover. Each of sleeves 24 is preferably formed in two sections. The first section **24*a* is attached at one end to the threaded nozzle fitting 18 of hose 20 that is attached to the water source line 14 or 16 and at its other end to interconnecting and bridging means 26. The second section 24*b* of sleeves 24 is attached at one end to interconnecting means 26 and at its other end to the appropriate washing machine inlet port. It is conceivable that each of sleeves 24 be formed as a single, integral piece being adapted to be coupled together by a bridging means positioned between sleeves 24. Sleeves 24 are designed to be of a greater diameter than hoses 20 so that they can easily slide over hose 20 and also be capable of capturing any water leaking from hose 20 in the event such hose leaks or ruptures. Sleeve 24** is preferably made of a flexible plastic material of a suitable strength to withstand a pressure of at least 100 psi.

Positioned between and coupling sections **24*a* and 24*b* of sleeves 24 together and coupling each of sleeves 24 to each other is interconnecting means 26. Interconnecting means 26 comprises a generally "H" shaped connector that has a bridging conduit 28 and two spaced apart pipes 30 coupled with and in communication with conduit 28. Conduit 28 also presents a means for attaching a drainage hose 34 thereto. As shown in FIGS. 1 and 2, an upwardly extending pipe 36 extends from conduit 28 for attachment of drainage hose 34. Interconnecting means 26 is preferably made of a rigid, hard plastic but any suitable material to withstand the forces of water is applicable. Interconnecting means 26 may be formed as a single integral piece having the generally "H" shape as described, or it can be produced by coupling three appropriately sized "T" fittings together. These "T" fittings can be found in any plumbing supply or hardware store. These fittings must be coupled in a leak-proof manner that is known to those skilled in the art. Interconnecting means 28 allows for any fluid that accumulates in sleeves 24 will be directed toward the interconnecting means 28 so that it is ultimately removed through drainage hose 34**.

In the event one of hoses 20 or fittings 18 break while in use, drainage hose 34 will direct the escaping water to a floor drain or standpipe 22. Drainage hose 34 can be placed directly into standpipe 22 if it is large enough to receive it. Since outlet hose 40 from washing machine 12 must also be placed into standpipe 22, it may be that standpipe 22 is not large enough to contain both hose 34 and outlet hose 40. In that situation, a "T" fitting 42 is fitted onto the free end of hose 34 at one outlet of "T" fitting 42, hose 40 is attached at a second outlet and a third hose 44 is attached to the third outlet in "T" fitting 42 and then hose 44 is placed into the standpipe 22. This allows any water that would be collected in sleeves 24 or in outlet hose 40 to be directed into standpipe 22.

Preferably, a backflow prevention valve 38 is placed between pipe 36 and drainage hose 34 to prevent any fluid from sewer or standpipe 22 that may back up therein from entering the sleeves of device 10 and possibly contaminating the clean water supply.

Backflow prevention valve 38 is more particularly shown in FIG. 3. Valve 38 includes threaded fittings 46 at both of its ends. The valve mechanism is located inside a chamber 48 and can be of any appropriate type so as to allow water to flow in only one direction through the valve and out through drainage hose 34. Thus, valve 38 prevents flow of water through hose 34 into the interconnecting means 26 and sleeves 24. The type of valve shown in FIG. 3 is a spring-loaded plunger type, but any similar type of valve is equally useful. In order to attach backflow protection valve 38 to bridging conduit 28, a threaded coupling 50 is threaded into the lower threaded fitting 46 and inserted into a similarly threaded pipe 36. A threaded coupling 52 is threaded into the other threaded fitting 46 for attachment to hose 34. As shown in FIG. 2, threaded coupling 52 has a first threaded section 54 and a male fitting section 56 for insertion into hose 34. It is to be understood that any other appropriate means for connecting valve 38 to drainage pipe 34 and interconnecting means 28 can be utilized without departing from the scope of the invention.

As best illustrated in FIG. 4, sleeves 24 are of a greater diameter than hoses 20. In order to obtain a tight, leakage free fitting of sleeves 24 around the threaded nozzle fitting 18 on the water line spout, a washer 58 is placed between threaded nozzle fitting 18 and the inside of sleeves 24. Washer 58 is of a diameter to accommodate the difference between the diameter of threaded nozzle fitting 18 and the diameter of sleeve 24. Washer 58 can be appropriately sized to fit any sized fitting or any sized sleeve. Washer 58 is placed about threaded nozzle fitting 18 and sleeve 24 is then placed over washer 58. Hose clamp 60 is then placed around the sleeve in the area where washer 58 is located and hose clamp 60 is tightened to obtain a secure, leak free fitting. Hose clamp 60 can be of any general type, preferably the adjustable type that can be easily adjusted by a screwdriver as shown in FIG. 2.

In use, the device 10 is assembled as shown in FIG. 1 and attached to an appliance such as washing machine 12. This configuration creates a chamber around hoses 20 for any water or fluid to be captured in the event of leakage. In the event that a hose 20 would begin to leak or would exhibit complete failure by rupture, the water would be collected in sleeves 24 and would eventually be directed through bridging conduit 28 to hose 34 and into standpipe 22 or an appropriate drainage site. This prevents flooding and damage to the area surrounding the appliance in the event of an unexpected, sudden hose rupture.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A device for protecting an appliance having at least two fluid inlet hoses that are connected at one end to a fluid source and at an opposite end to said appliance through use of nozzle fittings on both ends of said hose, and where said appliance is placed in proximity to a drainage site, said device comprising:

sleeves adapted to be fitted over said fluid inlet hoses;

means for interconnecting said sleeves; and a drainage hose coupled to one of said sleeves and said interconnecting means and capable of being removably fitted into said drainage site so that excess fluid leaking from said inlet hoses may be transported to said drainage site.

2. The invention as set forth in claim 1, wherein said interconnecting means is a conduit that includes means for coupling said conduit to said sleeves and for coupling said drainage hose to said conduit.

3. The device as set forth in claim 2 wherein said device further comprises a backflow prevention valve coupled between said conduit and said drainage hose.

4. The device as set forth in claim 1 wherein each of said sleeves further comprises a first section fitted over said fluid inlet hose between said fluid source and said interconnecting means; and a second section fitted over said fluid inlet hose between said interconnecting means and said appliance.

5. The device as set forth in claim 1 including washers removably fitted onto said fluid inlet hose nozzle fittings, said washers adapted to support said sleeves over said nozzle fittings.

6. The device as set forth in claim 5 including a hose clamp placed on the outside of said sleeves in relationship with said washer and said nozzle fittings to provide a secure connection between said sleeves and said fluid inlet hoses.

7. The device as set forth in claim 1 wherein the diameter of said sleeves is greater than the diameter of said fluid inlet hoses.

8. A device for protecting an appliance having two fluid inlet hoses that are connected at one end to a fluid source and at an opposite end to said appliance through use of nozzle fittings on both ends of said hose and where said appliance is placed in proximity to a drainage site, said device comprising:

a pair of flexible sleeves adapted to be fitted over said fluid inlet hoses;

means for interconnecting said pair of sleeves; and a flexible drainage hose coupled to said interconnecting means and capable of being removably fitted into said drainage site so that excess fluid leaking from said inlet hoses may be transported to said drainage site.

9. The device as set forth in claim 8 wherein means for coupling said conduit to said sleeves and means for coupling said flexible drainage hose to said conduit.

10. The device as set forth in claim 9 wherein each of said sleeves further comprises:

first and second sections, each said section having opposing ends, one end of each section being coupled to said rigid conduit in a manner interconnecting said sections and said pair of sleeves.

11. The device as set forth in claim 9 wherein said rigid conduit further comprises:

a first bridging pipe positioned between said sleeves;

two spaced apart connecting pipes coupled with said bridging pipe and having two opposing open ends for coupling with one end of said sleeves; and said rigid conduit presenting a pipe for coupling said drainage hose thereto.

12. The device as set forth in claim 8 including a backflow prevention valve connected between said interconnecting means and said flexible drainage hose.

* * * * *